US006928173B2

(12) United States Patent
Akino

(10) Patent No.: US 6,928,173 B2
(45) Date of Patent: Aug. 9, 2005

(54) CAPACITOR MICROPHONE

(75) Inventor: Hiroshi Akino, Sagamihara (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 571 days.

(21) Appl. No.: 10/165,872

(22) Filed: Jun. 10, 2002

(65) Prior Publication Data

US 2003/0007650 A1 Jan. 9, 2003

(30) Foreign Application Priority Data

Jul. 6, 2001 (JP) ..... 2001-205760

(51) Int. Cl.[7] ..... H04R 3/00
(52) U.S. Cl. ..... 381/111; 381/174
(58) Field of Search ..... 381/111, 112, 381/113, 174, 191

(56) References Cited

U.S. PATENT DOCUMENTS 6,549,631 B1 * 4/2003 Jackson ..... 381/111
6,697,493 B1 * 2/2004 Kern ..... 381/111

* cited by examiner

*Primary Examiner*—Xu Mei
*Assistant Examiner*—Brian T. Pendleton
(74) *Attorney, Agent, or Firm*—Welsh & Katz, Ltd.

(57) ABSTRACT

This present invention is related to a capacitor microphone. Capacitance change of a microphone unit without polarization voltage is converted to a digital signal to obtain a sound signal in order that the microphone restricts noise and the productivity of the microphone is increased. The capacitor microphone comprises a first oscillator 2 which outputs a sound signal varying frequency in response to capacitance change of the microphone unit 1, a second oscillator 3 which outputs a tracking signal varying frequency because of a control voltage CV, a phase comparator 4 comparing phases of the sound signal and the tracking signal to output lead or lag signal, and an adder-subtracter 14 outputting digital sound data. An adding-pulse signal and a subtracting-pulse signal, which are obtained by the logical product of the lead-phase or lag-phase signal and clock pulses, are inputted to the adder-subtracter 14.

2 Claims, 5 Drawing Sheets

CAPACITOR MICROPHONE

FIELD OF THE INVENTION

This present invention relates to a capacitor microphone, and more specially to a sound outputting a technology of a digital microphone of which capacitance formed between a vibrating plate and a fixed electrode is converted to digital signal to obtain a sound signal.

BACKGROUND OF THE INVENTION

A capacitor microphone is a type of microphones which have a sort of a capacitor formed by a assembly of a vibrating plate and a fixed electrode to extract electric signals, in which the electric signals are generated from capacitance change in response to the displacement of the vibrating plate vibrated by a sound wave. In capacitor microphones of the prior arts, it is required that DC voltage is supplied across the vibrating plate and the fixed electrode. The DC voltage is called as polarization voltage. There are two methods for supplying the polarization voltage, one is supplying DC voltage out of the microphone, the other is supplying polarization voltage by electret in the microphone.

A conventional capacitor microphone uses an impedance converter such as an FET (Field Effect Transistor) or a vacuum tube to obtain a specific level of a voltage signal, because impedance between the vibrating plate and the fixed electrode is much higher.

However, a conventional capacitor microphone described above is easily affected by outside electric or magnetic fields when capacitance change is converted to voltage, so that noise may be generated. Further, a conventional capacitor microphone uses an impedance converter in which charge leakage inherent thereto may be occurred, for example, when humidity is high. The charge leakage may also generate noise.

A conventional capacitor microphone using electret in a microphone unit to supply polarization voltage is enable to be produced small-sizedly, for example, to use for a cellular phone, however, when the capacitor microphone is mounted on a substrate, the reflow-soldering method may not be used because electret is affected by heat. Therefore, electret is required to be mounted separately on the substrate after chip resistors and capacitors have been mounted, so that the productivity of these capacitor microphones is low.

SUMMARY OF THE INVENTION

This present invention is carried out to solve the problems described above. The object of the invention is to provide a capacitor microphone which obtains a sound signal in the manner that capacitor change of a microphone unit, of which polarization voltage is not required, is converted to digital signal in order that noise does not occur from the capacitor microphone and the productivity thereof is increased.

In order to carry out above-described objects, the capacitor microphone of this invention comprises a microphone unit varying capacitance in response to inputted sound pressure, a first oscillator, a second oscillator, a phase synchronous means, a clock pulse oscillator generating clock pulses, a first logical product circuit, a second logical product circuit and a adder-subtracter. The first oscillator outputs a sound signal of which frequency varies in response to the capacitance and the second oscillator outputs a tracking signal of which frequency varies in response to a control voltage. The phase synchronous means obtains the sound signal and the tracking signal and outputs the first control signal when the phase of the sound signal leads the phase of the tracking signal, while the phase synchronous means outputs the second control signal when the phase of the sound signal lags behind the phase of the tracking signal, so that the control voltage is controlled in order that both phases of the sound signal and tracking signal become equal. The first logical product circuit outputs an adding-pulse signal generated by the logical product of the first control signal and the clock pulses. The second logical product circuit outputs a subtracting-pulse signal generated by the logical product of the second control signal and the clock pulses. The adder-subtracter outputs digital sound data by counting the adding-pulse signal and the subtracting-pulse signal.

According to the structure described above, since capacitance change is not converted to voltage, bad influences of the outside electric field or electromagnetic field may be restricted and thereby the noise generated may also be restricted. Further, since a polarization voltage generated by material such as electret is not needed in the microphone unit, the capacitor microphone of this invention may use the reflow-soldering method to surface-mount chip-components such as resistors or capacitors, so that the productivity of the microphones may be increased.

BRIEF DESCRIPTION OF THE DRAWINGS

FIG. 2(*b*) illustrates a sound signal W1 showing the magnitude of frequency outputted from a first oscillator 2. The vertical and lateral axes of FIG. 2(*b*) indicate frequency and time, respectively.

FIG. 3(*b*) shows a waveform of a first control signal S1 outputted from one output terminal 4*u* of the phase comparator 4, and FIG. 3(*c*) shows a waveform of a second control signal S2 outputted from the other output terminal 4*d* of the phase comparator 4.

FIG. 5(*c*) shows a waveform of an subtracting-pulse signal P2.

DETAILED DESCRIPTION OF THE PREFERRED EMBODIMENTS

With reference to the drawings, the preferred embodiment of a microphone of this present invention will be described in detail hereinafter.

Figure 1:
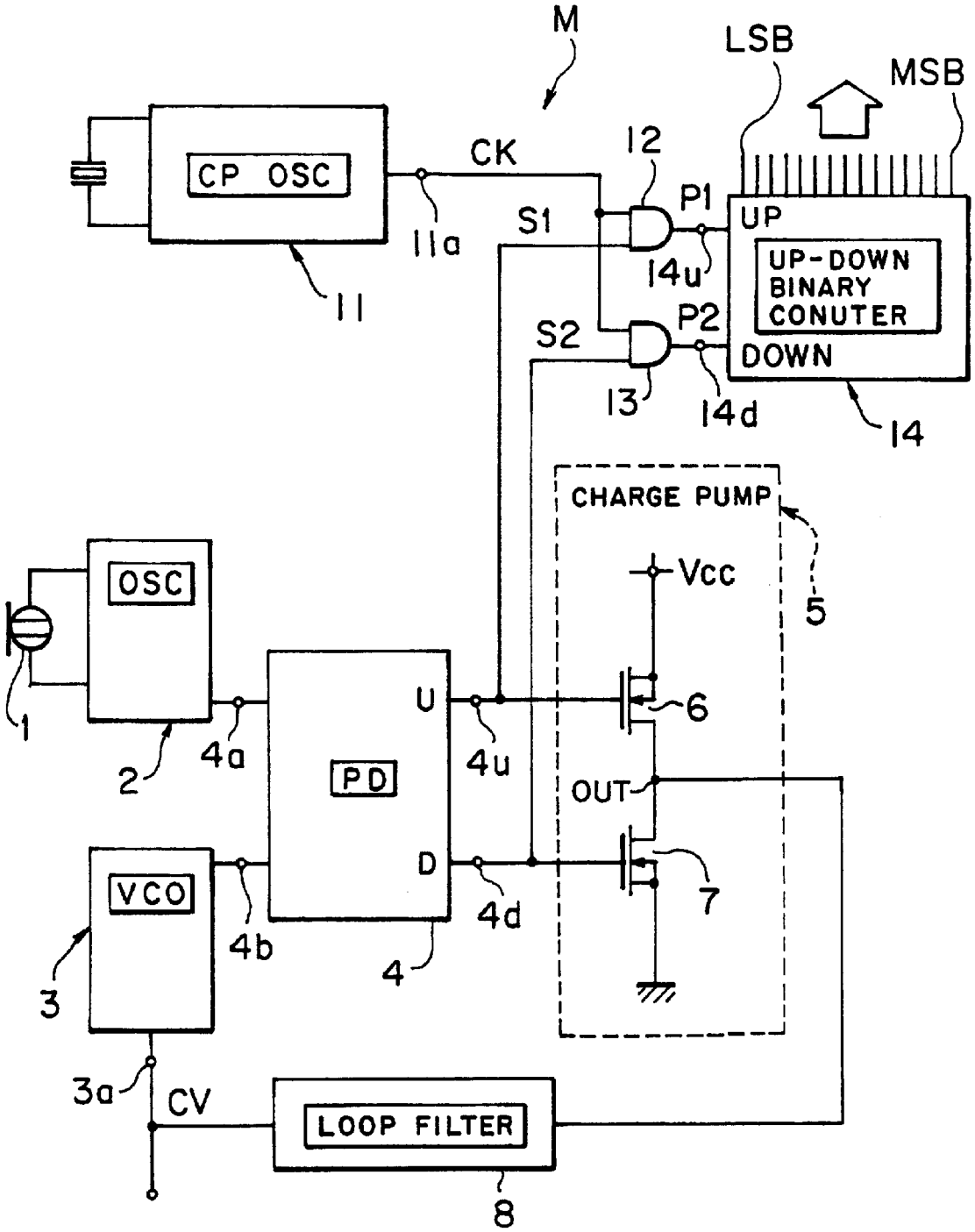
FIG. 1 is a schematic circuit diagram of a capacitor microphone in accordance with a preferred embodiment of the present invention.

As shown in FIG. 1, a microphone M comprises a first oscillator 2 having a microphone unit 1, a second oscillator 3 including a VCO (Voltage Control Oscillator), a phase comparator 4 comparing the phases of frequency waves outputted from the first and the second oscillators 2 and 3, a charge pump 5 including a pair of FETs (Field Effect Transistors) 6 and 7 for supplying charge, a loop filter 8 having components such as resistors and capacitors, a clock pulse oscillator 11 such as a crystal oscillation circuit, a first logical product circuit 12, a second logical product circuit 13, and an adder-subtracter 14 outputting digital sound data.

The microphone unit 1 comprises a vibrating plate which is vibrated by inputted sound pressure and a fixed electrode, wherein capacitance formed between the vibrating plate and the fixed electrode is varied in response to the displacement of the vibrating plate. In this invention, the structure of the microphone unit 1 may be the most simple, and the microphone unit 1 requires no polarization voltage which is generated by material such as electret.

The first oscillator 2 varies an oscillating frequency in response to capacitance change of the microphone unit 1. The first oscillator 2 operates as a C–F converter (Capacitance to Frequency converter) and feeds the sound signal to one input terminal 4*a* of the phase comparator 4. The frequency of the sound signal is proportional to sound pressure inputted to the microphone unit 1. A tracking signal for following the sound signal is fed to the other input terminal 4*b* of the phase comparator 4 from the second oscillator 3.

The phase comparator 4 compares the phase of the sound signal from the first oscillator 2 with the phase of the tracking signal from the second oscillator 3, so that the phase comparator 4 outputs a first control signal S1 to a first output terminal 4*u* when the phase of the sound signal leads the phase of the tracking signal, while the phase comparator 4 outputs a second control signal S2 to the second output terminal 4*d* when the phase of the sound signal lags behind the phase of the tracking signal.

In this embodiment, the phase comparator 4 is a phase frequency comparator which operates at the leading edge of an input wave, and for example, the integrated circuit such as MC4044 of Motorola Inc may be used.

The phase comparator 4 forms a phase synchronous loop of the second oscillator 3 in accompany with the charge pump 5 connected to the rear of the phase comparator 4 and the loop filter 8 connected to the charge pump 5. The charge pump 5 has a pair of FETs 6 and 7. The first output terminal 4*u* of the phase comparator 4 is connected to the gate terminal of one FET 6, while the second output terminal 4*d* is connected to the gate terminal of the other FET 7.

The drain terminal of the FET 6 is connected to the voltage line VCC of the microphone circuit, and the drain of the FET 7 is connected to the ground line of the microphone circuit. The both of the source terminals of FETs 6 and 7 are connected to each others, in which the connecting point of the both source terminals is an output terminal OUT. The output terminal OUT is connected to a control terminal 3*a* of the second oscillator 3 through the loop filter 8.

One FET 6 turns ON because of the first control signal S1 appeared at the first output terminal 4*u* when the phase of the sound signal leads the one of the tracking signal, so that the specific voltage is added to the control terminal 3*a* of the second oscillator 3 through the loop filter 8 from the voltage line VCC of the microphone circuit.

While the other FET 7 turns ON because of the second control signal S2 appeared at the second output terminal 4*d*, so that the specific voltage is sunk from the control terminal 3*a* of the second oscillator 3 to the ground line of the microphone circuit. Therefore, it will be controlled that the phase of the tracking signal becomes equal to the one of the sound signal. In this embodiment, the FETs 6 and 7 are MOS types of FETs, however, the junction types of FETs may be employed.

A clock output terminal 11*a* of a clock pulse oscillator 11 is connected to one input terminal of a first logical product circuit 12 of dual inputs type and also to one input terminal of a second logical product circuit 13 of dual inputs type.

The other input terminal of the first logical product circuit 12 is connected to the first output terminal 4*u* of the phase comparator 4, and the other input terminal of the second logical product circuit 13 is connected to the second output terminal 4*d* of the phase comparator 4.

An output terminal of the first logical product circuit 12 is connected to an adding-pulse input terminal 14*u* of the adder-subtracter 14 and an output terminal of the second logical product circuit 13 is connected to a subtracting-pulse input terminal 14*d* of the adder-subtracter 14.

Figure 2A:
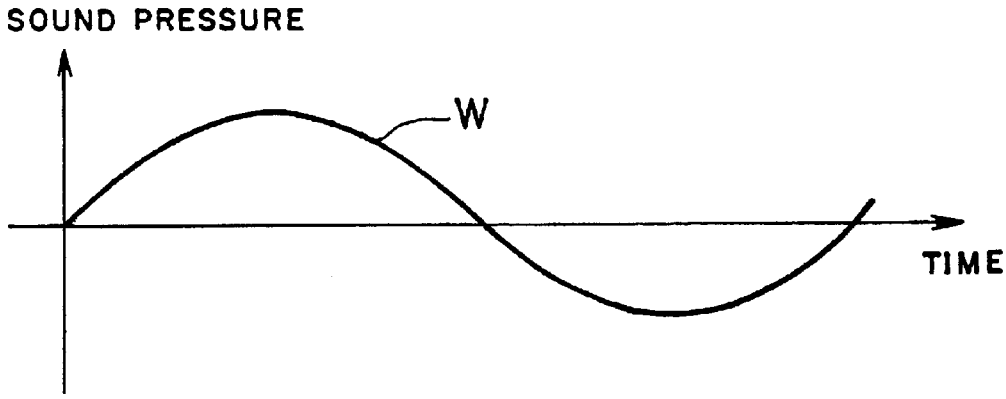
FIG. 2(*a*) is a schematic view of a waveform of sound pressure W inputted to a microphone unit 1.
Figure 2B:
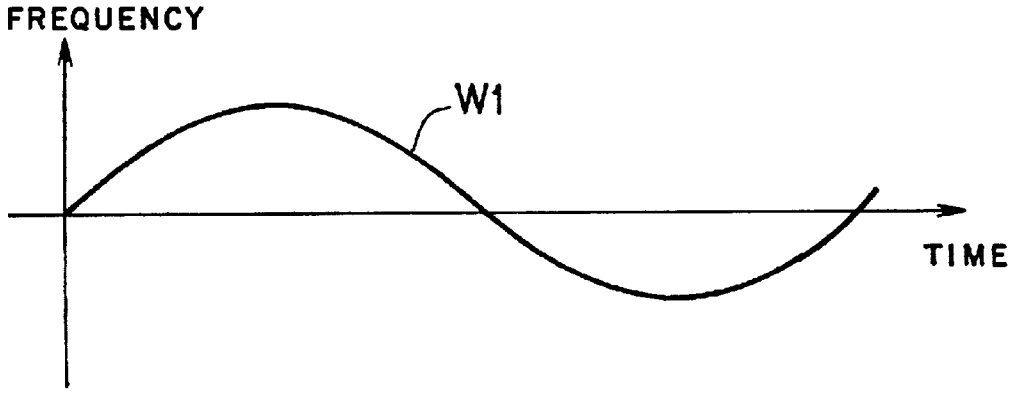
Figure 3A:
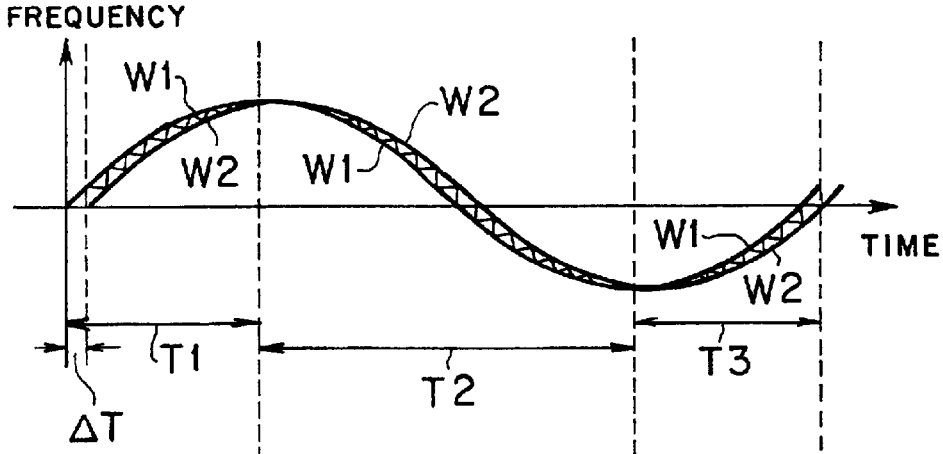
FIG. 3(*a*) is a schematic view of which the sound signal W1 and a tracking signal W2 are shown together to be compared, wherein the sound signal W1 is inputted to one input terminal 4*a* of a phase comparator 4, while the tracking signal W2 is inputted to the other input terminal 4*b* of the phase comparator 4.
Figure 3B:
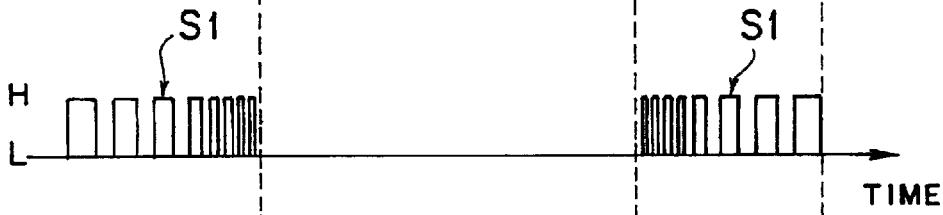
Figure 3C:
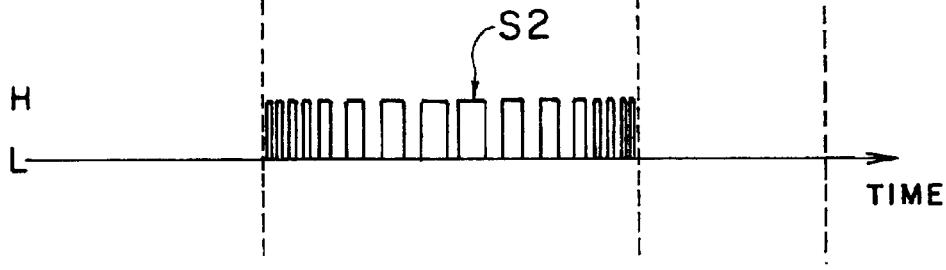

With reference to FIGS. 2 and 3, the operation of the microphone M will be described in detail hereinafter. For example, when sound pressure W shown in FIG. 2(*a*) is inputted to the microphone unit 1, the capacitance of the microphone unit 1 varies so that the oscillatory frequency of the first oscillator 2 varies in response to the capacitance.

That is, the capacitance of the microphone unit 1 is converted to a frequency signal by the first oscillator 2 and the frequency signal is fed to one input terminal 4*a* of the phase comparator 4, in which the frequency signal is designated as the sound signal WI in FIG. 2(*b*). The vertical and the lateral axes of FIG. 2(*b*) indicate frequency and time, respectively.

The tracking signal is inputted to the other input terminal 4*b* of the phase comparator 4 from the second oscillator 3. The relationship of the sound signal W1 and the tracking signal W2 are illustrated in FIG. 3(*a*). In the phase comparator 4 the phases of the sound signal W1 and the tracking signal W2 are compared and it will take time difference $\Delta T$ until the frequency of the tracking signal W2 becomes equal to the one of the sound signal W1 because of the transfer time required for controlling the second oscillator 3 in the phase synchronous loop.

In the example of FIG. 3(*a*), since the frequency of the sound signal W1 is greater than the one of the tracking signal W2 in the intervals of T1 and T3, the phase of the sound signal W1 leads the one of the tracking signal W2.

Therefore, as shown in FIG. 3(*b*), the first control signal S1 is outputted only from one output terminal 4*u* of the phase comparator 4 in the intervals T1 and T3. The pulse width of the first control signal S1 varies in proportion to the phase difference between the sound and the tracking signals W1 and W2.

While, in the interval T2, the frequency of the sound signal W1 is smaller than the one of the tracking signal W2 so that the phase of the sound signal W1 lags behind the one of the tracking signal W2.

Therefore, as shown in FIG. 3(*c*), the second control signal S2 is outputted only from the other output terminal 4*d* of the phase comparator 4 in the interval T2. The pulse width of the second control signal S2 varies in proportion to the amount of the phase lag.

In accordance with the above-described manner, the input sound pressure W in FIG. 1 is pulse-width-modulated by the phase differences between the sound signal WI and the tracking signal W2 so that the first and the second control signals S1 and S2 having the pulse widths in response to the phase differences are outputted.

Figure 4:
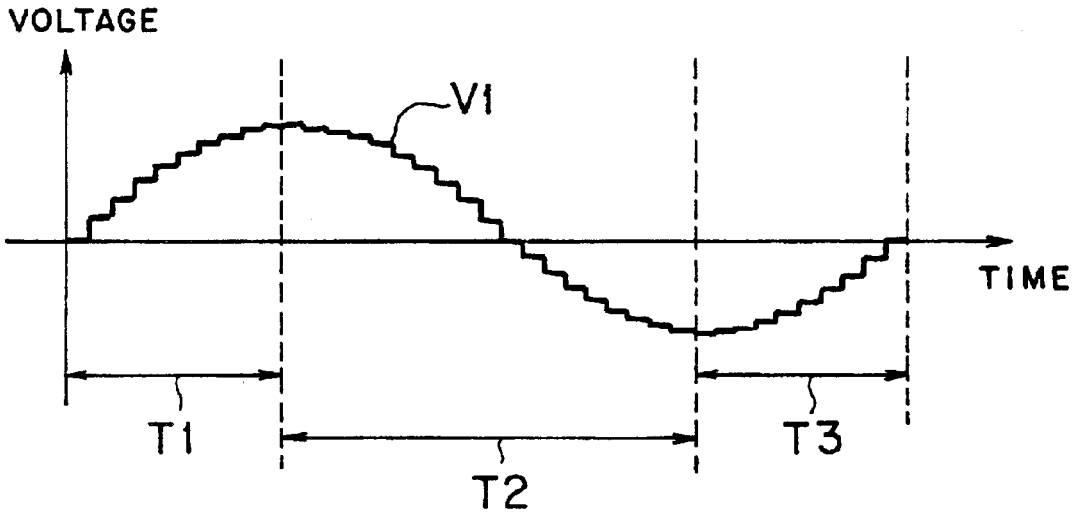
FIG. 4 shows an output waveform outputted from an output terminal OUT of a charge pump 5.

The FETs 6 and 7 of the charge pump 5 turn ON or OFF because of the first and the second control signals S1 and S2, and the voltage V1 shown in FIG. 4 appears at the output terminal OUT of the charge pump 5.

That is, in the interval T1 and T3 when the first control signal S1 is outputted, the voltage V1 increases step by step in response to the pulse width thereof, while in the interval T2 when the second control signal S2 is outputted, the voltage V1 decreases step by step in response to the pulse width thereof. The harmonic components included in the voltage V1 is removed by the loop filter 8 so that the smooth wave, of which the wave form is not step-by-step, is inputted to the control terminal 3*a* of the second oscillator 3 as a control voltage CV. Accordingly, the second oscillator 3 operates so as to oscillate the same frequency as the one of the first oscillator 2. For example, MC4024 of Motorola Inc. may be used as the second oscillator 3.

Figure 5A:
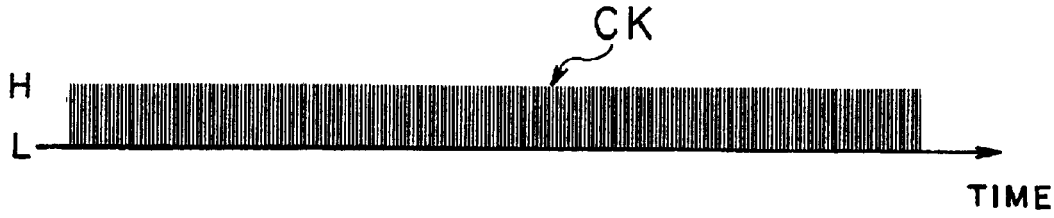
FIG. 5(*a*) shows clock pulses CK outputted from a clock pulse oscillator 11 and FIG. 5(*b*) shows a waveform of an adding-pulse signal P1.
Figure 5B:
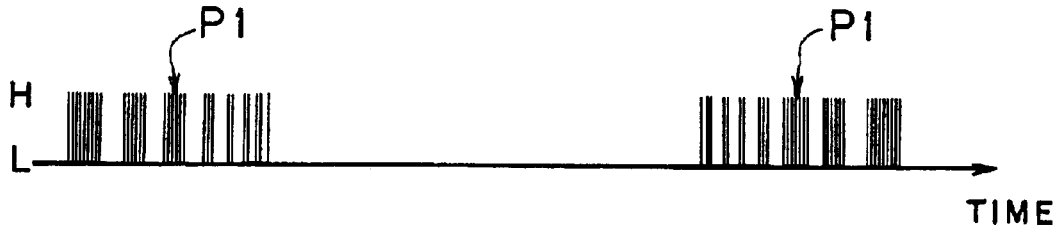
Figure 5C:
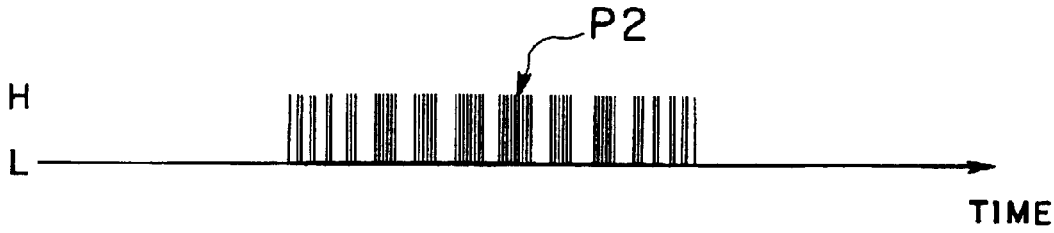

As shown in FIG. 5(*a*), a clock pulse oscillator 11 generates clock pulses CK and the clock pulses CK are inputted to the first and the second logical product circuits 12 and 13, wherein the pulse width of the clock pulse is sufficiently smaller than the time width of the first control signal S1 or the second control signal S2.

The first logical product circuit 12 calculates a logical product of the clock pulses CK and the first control signal S1 and supplies an adding-pulse signal P1 shown in FIG. 5(*b*) to an adding-pulse input terminal 14*u* of the adder-subtracter 14.

While, the second logical product circuit 13 calculates a logical product of the clock pulses CK and the second control signal S2, and supplies a subtracting-pulse signal P2 shown in FIG. 5(*c*) to a subtracting-pulse input terminal 14*d* of the adder-subtracter 14.

That is, PNW (Pulse Number Modulation) is carried out by the first and the second logical product circuits 12 and 13, so that the first and the second control signals S1 and S2 are respectively converted to the number of the pulses of the clock pulses CK in response to the pulse width of the control signals 12 and 13.

The adder-subtracter (up-down binary counter) 14 adds or subtracts reversibly based on the adding-pulse signal P1 or the subtracting-pulse signal P2, and outputs sound data as a parallel of the data through bit terminals from MSB (Most Significant Bit) to LSB (Least Significant Bit) of the adder-subtracter 14.

Wherein the adder-subtracter 14 holds the previous state before the phases change and counts up or down only when the phases change. The sound data outputted from the adder-subtracter 14 will be digital to analog-converted and then is fed to an audio output portion which is not shown.

In the embodiment described above, a crystal oscillation circuit is used as the clock pulse oscillator 11, however, an alternative such as a CR oscillation circuit, a LC oscillation circuit, or a multi-vibrator may be used. The adder-subtracter 14 may be alternated with a microprocessor. Further an analog type phase comparator may be used in place of the phase comparator 4, in this case, for example, it will be processed that an analog output signal is converted to digital data and then the converted digital data is inputted to the logical product circuits.

As described above, according to this invention, since capacitance change is converted not to voltage but to a digital signal to obtain a sound signal, noise generated by the outside electric field or electromagnetic field may be restricted. Further, an impedance converter is not employed, so that noise generated by the leakage of charge in the impedance converter may be also restricted.

Further, since a polarization voltage generated by material such as electret is not needed in the microphone unit, when components are mounted on the substrate of the microphone, electret which is affected by heat is not required to mount on the substrate and the reflow-soldering method may be used so that the productivity of the microphones may be increased.

What is claimed is:

1. A capacitor microphone comprises a microphone unit varying capacitance in response to inputted sound pressure, a first oscillator, a second oscillator, a phase synchronous means, a clock pulse oscillator generating clock pulses, a first logical product circuit, a second logical product circuit and a adder-subtracter, wherein said first oscillator outputs a sound signal of which frequency varies in response to the capacitance and said second oscillator outputs a tracking signal of which frequency varies in response to a control voltage, wherein said phase synchronous means obtains the sound signal and the tracking signal, and outputs the first control signal when the phase of the sound signal leads the phase of the tracking signal, while the phase synchronous means outputs the second control signal when the phase of the sound signal lags behind the phase of the tracking signal, so that the control voltage is controlled in order that both phases of the sound signal and tracking signal become equal, wherein said first logical product circuit outputs an adding-pulse signal generated by the logical product of the first control signal and the clock pulses, and said second logical product circuit outputs a subtracting-pulse signal generated by the logical product of the second control signal and the clock pulses, wherein said adder-subtracter outputs digital sound data by counting the adding-pulse signal and the subtracting-pulse signal.

2. A capacitor microphone according to claim 1, wherein said microphone unit is required no polarization voltage.

* * * * *